US011033155B2

(12) United States Patent
Brormann

(10) Patent No.: US 11,033,155 B2
(45) Date of Patent: Jun. 15, 2021

(54) BATHTUB AND METHOD FOR EMPTYING THE SAME

(71) Applicant: Febromed GmbH & Co. KG, Oelde (DE)

(72) Inventor: Hubert Brormann, Oelde (DE)

(73) Assignee: Febromed GmbH & Co. KG, Oelde (DE)

( * ) Notice: Subject to any disclaimer, the term of this patent is extended or adjusted under 35 U.S.C. 154(b) by 44 days.

(21) Appl. No.: 15/990,804

(22) Filed: May 28, 2018

(65) Prior Publication Data

US 2018/0338646 A1 Nov. 29, 2018

(30) Foreign Application Priority Data

May 29, 2017 (DE) ..... 10 2017 111 638.9
May 29, 2017 (DE) ..... 20 2017 103 218.3
Oct. 23, 2017 (DE) ..... 10 2017 124 657.6

(51) Int. Cl.
*A47K 3/02* (2006.01)
*A47K 3/074* (2006.01)
*A47K 3/164* (2006.01)

(52) U.S. Cl.
CPC ..... *A47K 3/02* (2013.01); *A47K 3/074* (2013.01); *A47K 3/164* (2013.01)

(58) Field of Classification Search
CPC ..... A47K 3/02; A47K 3/024; A47K 3/034; A47K 3/074; A47K 3/164
USPC ..... 4/594, 572.1
See application file for complete search history.

(56) References Cited

U.S. PATENT DOCUMENTS 2,765,475 A * 10/1956 Nolan ..... A47K 3/034 4/572.1
4,530,121 A 7/1985 Penney
4,592,099 A * 6/1986 Zellner ..... A61G 7/1003 4/540
4,809,368 A * 3/1989 Johansson ..... A47K 3/02 4/540
5,410,764 A 5/1995 Darnell
6,076,203 A 6/2000 Karhumaki
(Continued)

FOREIGN PATENT DOCUMENTS

DE 48 858 A 3/1889
DE 18 42 974 U 12/1961
(Continued)

OTHER PUBLICATIONS

Recherchebericht (search report) for patent application DE 10 2017 111 638.9 dated Mar. 28, 2018.

*Primary Examiner* — Christine J Skubinna
(74) *Attorney, Agent, or Firm* — Robert Dabney Eastham

(57) ABSTRACT

A bathtub comprises a frame structure and a tub body. The tub body is pivotally accommodated at the frame structure wherein the tub body is pivotable between a bathing position and an emptying position. The method of emptying the bathtub is distinguished in that the tub body pivots from the bathing position to the emptying position. Another bathtub comprises a frame structure and at least one tub body, the tub body being accommodated on the frame structure and wherein a drainage device is disposed in the bottom of the tub body. The drainage device comprises at least one tube extending from the drain hole of the drainage device up to beneath the tub body.

28 Claims, 8 Drawing Sheets

(56) References Cited

U.S. PATENT DOCUMENTS

| | | | | |
|---|---|---|---|---|
| 6,785,917 | B1 * | 9/2004 | Bryant | A47K 3/024 4/572.1 |
| 7,310,834 | B2 | 12/2007 | Karhumaki | |
| 7,849,528 | B1 * | 12/2010 | Tuday | A61H 33/10 4/498 |
| 2002/0184704 | A1 * | 12/2002 | Cawthon | A22C 25/025 4/619 |
| 2008/0141452 | A1 * | 6/2008 | Karbowski | A47K 3/064 4/572.1 |

FOREIGN PATENT DOCUMENTS

| | | | |
|---|---|---|---|
| DE | 18 71 329 | U | 5/1963 |
| DE | 24 31 651 | A1 | 1/1975 |
| DE | 198 18 903 | A1 | 10/1999 |
| EP | 0 231 563 | A1 | 8/1987 |
| EP | 2 309 898 | A | 8/1987 |
| EP | 0 284 644 | A2 | 10/1988 |
| WO | 97/ 32 510 | A1 | 9/1997 |
| WO | 2004/ 012 568 | A1 | 2/2004 |
| WO | 2011/ 155 856 | A1 | 12/2011 |

* cited by examiner

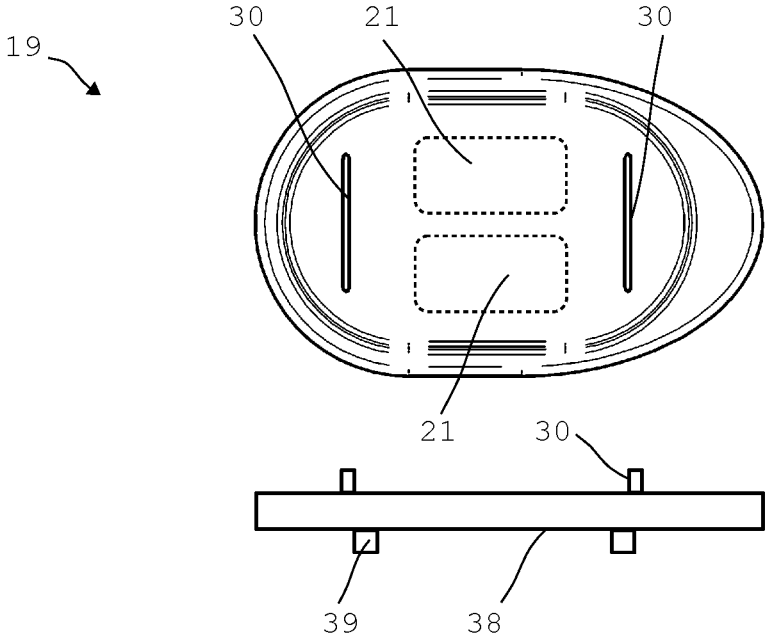
Fig. 9A
Fig. 9B
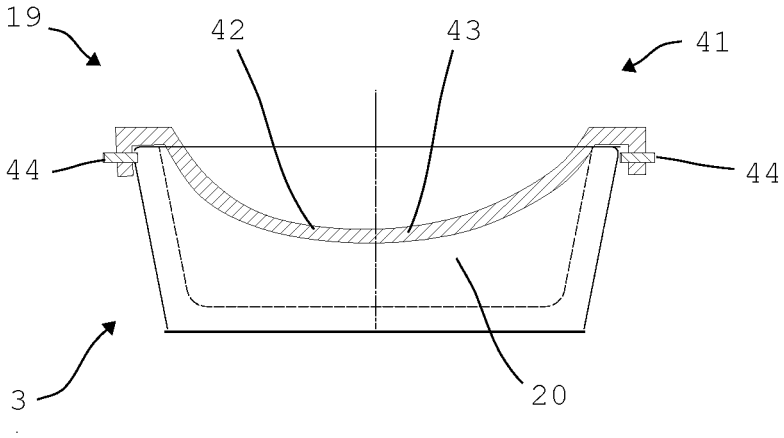
Fig. 10

BATHTUB AND METHOD FOR EMPTYING THE SAME

TECHNICAL FIELD

The present invention relates to a bathtub, in particular a baby and/or infant bathtub, comprising at least one frame structure and at least one tub body. Optionally at least one drainage device is provided in the bottom of the tub body. The present invention also relates to a method of emptying a bathtub.

BACKGROUND

For bathtubs in medical applications, hygiene is particularly significant. In particular for baby bathtubs or infant bathtubs as they may also be used in intensive pediatric care and/or premature baby wards, a fast and reliable processing regime that meets the highest hygiene standards is called for. "Processing" in the context of this specification will be understood to mean cleaning and disinfecting with soapy water, disinfectants, steam, and/or heat.

These baby bathtubs are as a rule mobile in configuration and thus they have no permanent, fixed fresh water inlet and waste water drain.

The bathtub drain is particularly critical as regards hygiene. For example if a usual plug is used for a stopper, the nursing staff members need to dip their hands into the water for removing the plug. The risk of subsequent contamination is thus high.

The drain itself is also a major risk in terms of hygiene. A small gap tends to remain between the drain, the tub bottom, and the sealing in which bacteria can settle and grow. Only aggressive cleaning agents enable hygienic processing. To this end, the bathtub is filled with special cleaning agents remaining therein for a certain time. This cleaning or processing of the bathtub takes relatively long and is furthermore rather expensive due to the use of large amounts of cleaning agent. Moreover the aggressive cleaning agents are a health hazard for the cleaning or nursing staff.

The interior of the drain hole, the drainpipe and other components are also highly problematical in terms of hygiene. Conventional drains are usually provided with a number of openings and projections in or on which germs and bacteria can settle and grow. Those openings and projections make cleaning the drain interior rather difficult. Even special cleaning agents cannot always ensure satisfactory processing because their residence time in the drainpipe tends to be short.

It is therefore the object of the present invention to provide a bathtub which enables faster, more reliable, and easier processing and that preferably enables lower-cost processing.

SUMMARY

This object is solved by a bathtub in particular a baby bathtub and/or an infant bathtub, comprising at least one frame structure and at least one tub body, characterized in that the tub body is pivotally accommodated on the frame structure, the tub body being pivotal at least between a bathing position and at least one emptying position, the tub body showing an entirely closed inner surface.

The object also is achieved by a method of emptying a bathtub according to the preceding paragraph characterized in that the tub body is pivoted from the bathing position to the emptying position for emptying the tub body.

The object also is achieved by a bathtub, in particular a baby bathtub and/or infant bathtub, comprising at least one frame structure and at least one tub body, wherein the tub body is accommodated on the frame structure and wherein at least one drainage device is disposed in the bottom of the tub body, characterized in that the drainage device comprises at least one tube extending from the drain hole of the drainage device up to beneath the tub body.

Further advantages and features of the invention can be taken from the exemplary embodiments.

The bathtub according to the invention provides in particular a baby- and/or infant bathtub. The bathtub comprises at least one frame structure and at least one tub body. The tub body is pivot-mounted on the frame structure so that the tub body can pivot at least between a bathing position and at least one emptying position.

The bathtub according to the invention is in particular intended for use in hospitals and/or care facilities for bathing persons, in particular infants, babies, and/or premature babies, in the bathtub. The persons bathed may also be sick or feeble.

To enable the most versatile use of the bathtub according to the invention including in patients' rooms the bathtub is preferably mobile or wheeled. The bathtub or the frame structure preferably comprises a wheeled base, i.e. a base to which rollers are attached. The base rollers are in particular equipped with brakes so as to enable securely locking the bathtub in place in any desired location.

Preferably at least two pairs of rollers, a pair of rear and front rollers each, are attached to the base. The two roller pairs may differ by their sizes and/or other characteristics. The rear roller pair is preferably larger than the front pair. The front roller pair has in particular smaller rollers preferably configured as swivel caster wheels.

In order to provide ease of locking the bathtub in place in a defined location the rear roller pair preferably has a brake arm for locking the rear roller pair in place as the brake is actuated. The preferred brake is one like a brake as they tend to be used in baby carriages.

To prevent as far as possible damaging furniture and/or walls and floors due to moving the bathtub, the bathtub and in particular the base may be provided e.g. with rubber pads and/or rollers. Other protectors may be conveniently employed.

Preferably the bathtub is configured as a baby and/or infant bathtub having a relatively small volumetric capacity for water. This bathtub may receive for example between 30 liter and 60 liter, for example 33 or else 50 liters. At any rate the preferred water level in the bathtub is 150 millimeters (mm) so as to provide ease of bathing babies and infants in the bathtub. Other water levels may be employed advantageously.

The tub body dimensions preferably have a length of about 50 centimeters (cm) to 100 cm and a width of about 30 cm to 60 cm. Other advantageous dimensions may be provided.

Other than being tiltable for emptying the bathtub the frame structure particularly preferably comprises a lifting column or similar suitable device for adjusting the height of the bathtub or the tub body for bathing and/or for emptying.

Thus it is in particular preferred to provide the lifting column vertically adjustable so that in the emptying position the tub body has a draining height of up to 1 meter or more. It is thus possible to empty the bathtub into a standard sink that as a rule has a height of 700 mm. Or else the bathtub may be discharged into any conventional wash basin having a draining height for example of 900 mm.

To provide a stable, safe stand of the bathtub even on a particularly high, extended working level, the frame structure and the frame structure base in particular is weighted so as to provide the bathtub with a rather low center of gravity. Thus for example a base weighing 40 kilogram (kg), 50 kg, 60 kg, 70 kg or more may be provided.

Low-friction rollers may preferably be provided to offer ease of moving the bathtub between locations. Or else it is possible to incorporate a drive system in the base of the frame structure. Then the bathtub may preferably move automatically e.g. by means of a remote control.

Preferably the tub body is fixedly connected with the frame structure. It may be screwed, glued, or pushed onto the frame structure. Other configurations also provide for detachably connecting the bathtub with the frame structure. Thus the tub body may be removed from the frame structure for example for processing the bathtub. An exchangeable tub body considerably reduces processing times respectively time intervals between using the bathtub.

The bathtub is preferably made of, or comprises, stainless steel and/or plastic or other materials. In particular the use of plastic allows the bathtub to be provided in child-friendly coloring. Glass-fiber reinforced plastic (GFRP) is a particularly suitable material for the bathtub, in particular for the tub body.

According to the invention the tub body is pivot-mounted on the frame structure, pivot-mounted in particular also meaning tiltable.

The tub body is preferably received on the frame structure so that it can be pivoted for discharging the water from the tub body into a suitable drain or sink. Pivoting may be provided for manual or else automatic or semi-automatic handling. Mechanical and/or electric pivoting is particularly preferred.

The bathtub according to the invention offers many advantages. It is a considerable advantage that the bathtub need not have a drain as far as a suitable pivotal design of the tub body on the frame structure permits. For emptying, the bathtub is pivoted or tilted in a suitable location, for example above a sink, so as to permit the water to flow out of the tub body into the sink.

Omitting a drain in the tub body allows at least the inner surface of the tub body to be entirely closed so as to provide a highly hygienic bathtub incurring particularly low treatment costs for processing and also permitting particularly fast processing.

Cleaning a bathtub after use involves a particularly high work input when processing a bathtub in a medical context. Cleaning the drain is particularly time-consuming.

A drain is a hygienic weak spot since drains are as a rule provided with a number of projections and optionally openings or cutouts in which germs can rapidly accumulate and grow. Cleaning these drains is difficult and requires aggressive cleaning agents as a rule. These cleaning agents are expensive, moreover they require long soaking times and removing or rinsing off the cleaning agent involves long times and high costs.

The bathtub design, which is preferably height-adjustable and provided for tilting the tub or pivoting the tub body, also offers a back-friendly and thus nurse-friendly bathtub.

The tub body preferably has an entirely closed inner surface. As has been discussed above, this is possible by not providing a drain at or in the tub body. This offers particular ease of cleaning or processing the bathtub for subsequent use.

The frame structure particularly preferably comprises at least one pivot device accommodating the tub body. This pivot device preferably comprises at least one pivot axle or at least one hinge and/or at least one joint for the tub body to pivot around. For example the frame structure may be provided with a pivoting or tilting plate and/or frame device to which the tub body is fastened. Tilting this plate or frame automatically brings the tub body to a certain inclination for emptying the water out of the tub.

The tub body preferably has a longitudinal extension and a shorter transverse extension with the pivot axle for the tub body being oriented substantially transverse to the longitudinal extension. This configuration enables emptying the bathtub particularly advantageously since the narrower side of the bathtub functions as a drain.

In convenient specific embodiments the pivot axle is provided in the top half, preferably in the top third and particularly preferably in the top quarter of the tub body. To this end the pivot device preferably comprises at least one supporting arm that provides the suspension of the tub body on the pivot axle. This supporting arm and/or other suitable device can displace the pivot axle to a top region, preferably around the tub body or along the tub body or embedded in the tub body. Preferably the supporting arm protrudes at least slightly from the frame structure base. Thus the tub can preferably be displaced sufficiently close to or above a basin for emptying. The configurations described above having a pivot axle disposed in the top half, top third, or top quarter of the tub body has the advantage that the sink or the edge of the tub body above or over which the water is discharged, remains quasi stationary. Thus the tub body does not require displacement to a great height for emptying, compared to a pivot axle in the lower region of the tub body.

Preferably the tub body comprises at least one discharging device. This discharging device supports the user in accurately targeted and hygienic emptying of the bathtub. This discharging device in particular provides a discharging aid that may for example be incorporated in the tub body and/or else be a separate component. Thus for example the side of the tub body over which the water is emptied out of the tub body may have a shape providing a substantially beak-like discharging aid structure.

A discharging device incorporated in the tub body preferably provides for the pivot axle to be connected with the tub body in the region of the discharging device. Depending on the configuration, a single or additional, separate discharging device may be provided which is hanged on, or into, the tub body, is clamped to, or fastened to the tub body for example by suction cups. This separate discharging device may for example be a sink gutter, a hose, tube and/or draining sheet across which the water is emptied or let out of the tub body into a suitable discharge. A telescopic pipe can in particular be provided which is only attached to the tub body for emptying the bathtub. Such telescopic pipe may preferably be extended to an advantageous length so as to prevent the water from splashing back from, or uncontrolled dribbling into, the sink as it is discharged from the tub body.

Thus, all the configurations having a discharging device in particular prevent contamination of faucet-mounted filter systems. Nor are other care products in the vicinity of wash basins dirtied or contaminated by the discharging water. Moreover, water is prevented from splashing as it hits the sink, which would cause contamination by bacteria from the bath water, and/or the sink.

In convenient configurations the pivot device comprises at least one push tube and/or at least one biasing device. In particular in conjunction with a pivoting lever connected with the push tube the tub body can thus be tilted or pivoted with ease for example by way of a spindle drive having e.g. a crank or other manual or electrical or mechanical operating device. A configuration having a biasing device is preferably configured as a pressure cylinder that may also provide damping. If a biasing device is used, tilting is preferably automatic or the user must first apply a certain initial force. A user may for example initiate tilting and thus emptying the tub body by way of slightly lifting or tilting the tub body. Although a lifting force of for example 3-8 kg may be advantageous, the lifting force required may be set higher or lower.

Preferably at least one blocking device is provided for preventing the tub body from pivoting at least when in the bathing position. The blocking device may then be released for pivoting the tub body. Spring locks may for example be provided so as to effectively prevent inadvertent pivoting of the tub body. Other locking devices can be used advantageously. Such a locking or securing device is in particular useful and preferred in particular for pivot devices comprising a biasing device which automatically continues or supports tilting of the tub body following an initial lifting force applied.

In advantageous specific embodiments the suspension of the push tube and/or the biasing device is configured for rotary motion. Thus the push tube or biasing device is preferably not fixedly screwed to or connected with the frame structure but is suitably supported on the frame structure for the push tube and/or the biasing device to deflect somewhat as the tub body pivots.

Preferably the push tube is intended for manual and/or automatic movement. Thus the push tube, which is in particular spindle-driven, can be displaced back and forth, preferably by means of a crank or else motorized, for example by means of a motor or else a cordless screwdriver for moving or pivoting or displacing the tub body between the bathing position and the emptying position.

Preferably at least one motor device is provided. This motor device is preferably utilizable for pivoting the tub body. The motor device is in particular provided for battery operation, preferably for cordless charging. To this end the bathtub may for example be functionally connected with an inductive charging dock so as to eliminate the need for plugging in cables and thus exposing electrical connections.

Particularly preferably the controlling in automatic operation or in pivoting the bathtub is configured so as to prevent inadvertent emptying or draining the bathtub during bathing. Thus, for example, finger-tip operation may be provided for the bathtub or the tub body to pivot only upon actuation of a push button. As the push button is released the bathtub stops automatically.

In the case of motorized pivoting the control device may in particular be integrated in the tub body and it may advantageously be provided by a touchpad or a touch panel, for example embedded in the edge of the tub body. In the case of automatic tub body pivoting, controlling for example by way of a software program used on a smartphone or mobile device (app) is also possible.

Particularly preferably the tub body is at least double-walled at least in sections. Thus, an insulating core, for example a PU foam core, may be provided in the tub body so as to maintain the water temperature in the tub body particularly well and for a particularly long time.

In convenient specific embodiments the angle between the bathing position and the emptying position is at least 30°, in particular at least 45°, preferably at least 60°, particularly preferably at least 75° and in particular preferably at least 90°. In the bathing position the tub body is preferably substantially horizontal. An angle of 45° to 90° or more ensures particular ease of completely emptying the tub body. An angle of 90° for example has the tub body substantially vertical so that the water flows completely and also quickly out of the tub body.

Preferably the tub body is configured jointless at least in a top region. Particularly preferably the tub body is configured entirely jointless, e.g. cast integrally. This is in particular preferred for a double-walled tub body. The particular advantage of a jointless configuration or an integrally manufactured tub body is the avoidance of critical areas such as joints or junction edges where bacteria tend to accumulate quickly. Scrubbing these areas is difficult and would increase the treatment costs for processing.

The tub body and in particular its inner surface is configured jointless and preferably the entire body is predominantly or entirely configured jointless.

GFRP is a particularly suitable material for the tub body and/or the frame structure or at least the frame structure cladding.

Particularly preferably at least one cover device for covering the tub body interior is provided. The tub body interior is the water receiving space or the space in which a child or infant or baby is placed for bathing.

Preferably the cover device has on its bottom face, bases respectively rubber bases or other base types for parking which allows the cover device to be placed, for example, on a table.

It is also preferred to provide the tub body and/or the frame structure with a suitable accommodation for hanging up or storing the cover device.

A cover device may preferably comprise at least one grip and in particular at least two grips so as to provide particular ease for a user to displace the cover truly horizontally.

Such a cover device may preferably be used in conjunction with a flexible hood, e.g. a film hood for the flexible hood to serve as a hygienic or predominantly sterile cover, which cover device may be used as a fixed cover and a resting surface as well.

Particularly preferably the tub body and/or the cover device provides at least one storage feature. This storage feature may for example be worked into the tub edge. This storage feature may be provided for example incorporated in a discharging device. The cover device may be provided with attached or integrated storage features. This storage space or storage feature is particularly advantageous for depositing care products or other items.

In convenient specific embodiment at least one tub insert may be provided that is preferably configured as a tub reduction.

This tub insert or tub reduction may in particular be placed onto the tub body edge, thus providing a reduced-size tub interior.

This is of particular advantage for bathing very small children or babies in the bathtub. The reduced tub space offers better support for very small children or babies, which makes bathing more pleasant for the children.

A tub insert may preferably be provided, or configured, as a cover device.

To ensure secure support of the tub insert, suitable fasteners are preferably provided for fastening the tub insert to the tub body at least temporarily.

The smaller volume of the tub insert or the tub reduction allows further reducing the amount of water required.

The tub insert can preferably be used separately. The tub reduction can for example be placed on a table and used separately.

The tub body is preferably configured for removal from the frame structure. Thus, depending on the configuration, the tub body may be used independently of the frame structure. Moreover the frame structure can preferably be used for other applications independently of the tub body. For example other devices such as a cot or the like may be connected with the frame structure. Thus the frame structure is preferably provided for versatile uses.

Particularly preferably the frame structure comprises a height-adjusting device that in particular comprises a pumping system. This pumping system in particular comprises at least one pedal pump or at least one hydraulic pedal pump. This allows lifting or lowering the tub body to a suitable height anytime by using a foot. Using a foot pump in particular achieves that height adjustment does not require the use of hands. The advantage thereof is in particular that the nursing staff can adjust the height of the tub even after inserting their hands into the bath water so that hygienic use of the hands would otherwise require scrubbing hands again. A pedal pump allows the nursing staff to adjust the height of the tub at any time while maintaining hygiene, for example, if a previously set height is less than optimal and may cause back pain.

In convenient configurations the frame structure comprises at least one stand having at least one fastener and/or at least one grip arrangement. This stand may in particular provide a base for the tub body to be set up, for example, immediately on the working surface next to a wash basin or onto a cart. Grips are preferably provided for ease of transporting the tub body with the frame structure. Fasteners such as suction cups or other detaching fasteners are preferably provided for ensuring safe use of the tub. Generally speaking the fasteners or fixing members are readily detachable. Thus, in particular bolts e.g. in conjunction with winged nuts, latches, ratchet straps, Velcro straps or else magnetic links may be used.

In all the configurations described it is preferred for at least one edge section of the tub body to have an ergonomic shape or shape sections for comfortably holding the baby in the tub. In particular one such shape section may be provided in the tub body edge or in the tub body for the person bathing a child to ergonomically position the person's arm against the tub body so as to relieve the weight on the arm during bathing. This shape section may be provided on both sides of the tub body to provide optimal use of the tub for both left-handed and right-handed persons.

The method of emptying a bathtub or draining a bathtub may be employed with a bathtub as it is described above. For emptying the tub body, the tub body is pivoted from the bathing position to the emptying position.

The tub body is positioned in front of or above a suitable sink preferably prior to pivoting from the bathing position to the emptying position. Thus the bathtub, if it is mobile, may for example be moved toward a wash basin or a sink or floor drainage.

In particular if the tub is emptied into a wash basin or sink, the level of a height-adjustable bathtub may be suitably set for particularly easy and hygienic dumping.

The method of emptying a bathtub also offers the advantages indicated above. It is in particular possible to provide a bathtub having no drain since the tub body is not emptied through an outlet but by means of pivoting or tilting the tub body.

Preferably the tub body is emptied by way of a separate discharging device attached to the tub body. Attaching a suitable separate discharging device, for example a sink gutter, hose, tube, and/or draining sheet, guides the water into the sink in emptying particularly targeted and without any splashing. Thus in particular germ contamination of faucet-mounted filter systems at wash basins or else of other care products in the vicinity of a wash basin or a sink is prevented.

While this discharging device is not in use it is preferably attached to or accommodated in the frame structure or the lifting column so that it can be docked to a tub body anytime as needed. Then the discharging device may in particular be hung into or clipped onto the tub body or else attached to the tub body by means of suction cups or other fasteners.

Particularly preferably the user releases the blocking device and then slightly lifts the tub body until the biasing device engages.

Another bathtub according to the invention is in particular configured as a baby- and/or infant bathtub. The bathtub comprises at least one frame structure and at least one tub body with the tub body accommodated on the frame structure and the bottom of the tub body having at least one drainage device. Furthermore the drainage device comprises at least one tube extending from the drain hole in the bottom of the tub body of the drainage device to beneath the tub body.

Other than the drainage device the bathtub is preferably configured like the bathtub discussed above. The bathtub is in particular mobile or movable and height-adjustable.

The drainage device may preferably be designed integral with the tub body or else as a separate component that is for example screwed to and/or glued into the tub body. In particular in the case of integral manufacturing a particularly hygienic drain us provided since a jointless connection between the drain and the tub body is provided. However, even if a separate component is used, the drain may be integrated in the tub bottom substantially jointless.

It is preferred for the drainage device to be configured on the whole without any edges or projections. The tube extending through the tub bottom to beneath the tub body is preferably linked to the drain hole jointless, on the whole providing a smooth surface or inner surface.

The tube extends at least as far as just beneath the tub body so as to provide a connection for example for a hose. The tube in particular protrudes at least 0.5 cm, preferably at least 1 cm and in particular at least 2 cm downwardly beyond the tub body.

The tube extends to beneath the tub body. A further routing for the outflowing water may be readily attached and/or removed in this place.

This bathtub again offers many advantages. It is a considerable advantage that the treatment costs for processing can again be considerably reduced. This is possible by providing an easy-to-clean smooth tube for draining the water from the tub body.

This tube extends to beneath the tub bottom so that any other components, which may be difficult to process, can be removed for processing the tub body and for example be autoclaved or sterilized in other cleaning systems or else be processed in some other way.

Preferably at least one quick release device and/or at least one hose device can be attached to the bottom end of the tube. Thus, a waste water line, for example a hose, tube, or other waste water line extension can be connected with the tube. Then a hose may be connected with the tube for a drain extension through a quick release, or a hose can be directly attached to the tube for example by clamp connection. Thus, such connection can be readily and quickly removed from the bathtub for cleaning or processing.

The smooth drainpipe can be easily cleaned, for example with a brush and a suitable cleaning agent.

Particularly preferably at least one holding device for at least one hose device is disposed in particular on the outside surface of the tub body. The holding device is in particular disposed in a position on a level higher than the water level used in the tub. Thus for example a hose may be connected with the tube of the drainage device and guided upwardly and hooked up to the holding device. This provides for automatic closing of the drainage device since the free end of the hose lies above the water level in the tub body. For draining the water the hose may be taken off of the holding device and moved downwardly toward a drain.

Preferably the frame structure comprises at least one accommodation for at least one bucket or other container. A kind of parking space or conveying space may in particular be provided on the frame structure, preferably at or in the frame structure base for transporting for example a bucket or other container together with the bathtub.

Thus the water in the tub body can preferably be poured into the sink outlet or a bucket in batches to then be drained into a sink or wash basin or a toilet bowl. Batchwise draining the water may ensure a back-friendly emptying of the bathtub.

Further advantages and features of the present invention can be taken from the exemplary embodiment that will be described below with reference to the enclosed figures.

BRIEF DESCRIPTION OF DRAWINGS

FIG. 9A is a simple schematic illustrations of a cover device for a bathtub according to the invention in a top view;

FIG. 9B is a simple schematic illustrations of a cover device for a bathtub according to the invention in a side view;

FIG. 10 is a simple schematic illustration of the tub body of a bathtub according to the invention with a tub insert;

DETAILED DESCRIPTION OF EMBODIMENT

Figure 1:
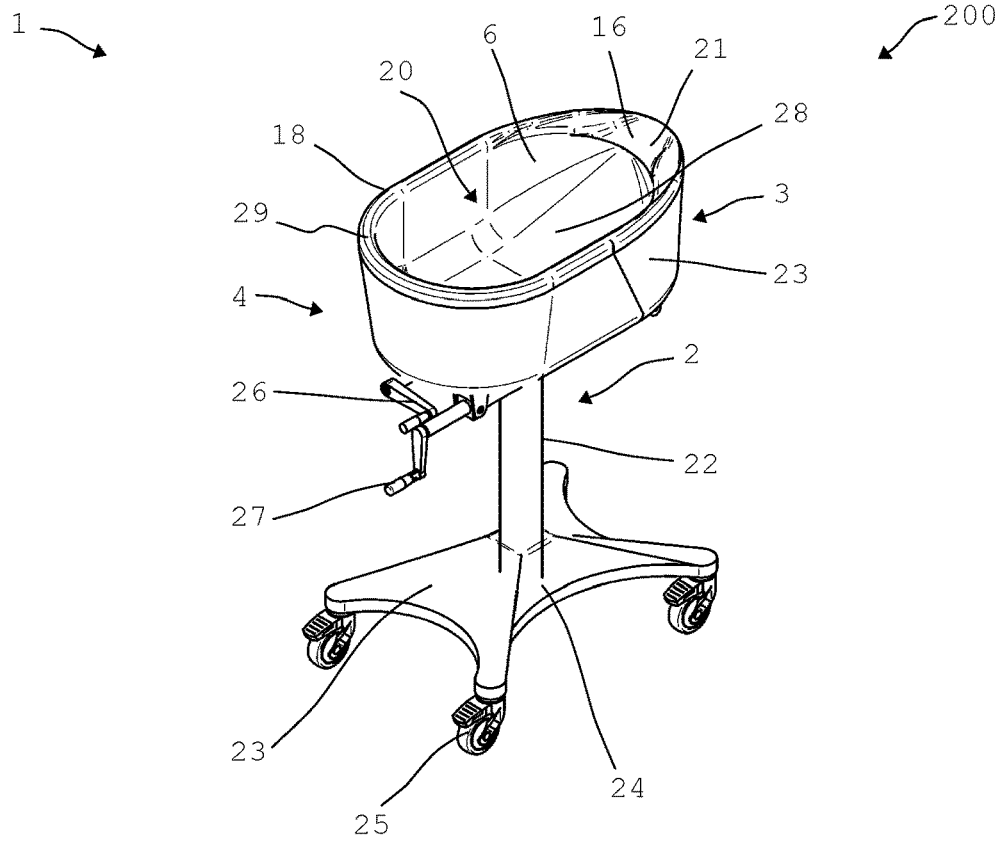
FIG. 1 is a simple schematic illustration of a bathtub according to the invention in the bathing position in a perspective view.

FIG. 1 is a perspective view of a simple schematic illustration of a bathtub 1 according to the invention, the embodiment shown being configured as a baby bathtub and/or infant bathtub 200. In the embodiment shown the bathtub 1 comprises a frame structure 2 on which a tub body 3 is placed.

The tub body 3 or the shell of the tub body 3 is preferably made of GFRP. This is a double-walled configuration with an insulating core, presently a polyurethane (PU) foam, disposed in the interior of the tub body 3.

The tub body 3 or the shell of the tub body 3 in the exemplary embodiment shown is manufactured one-piece around the insulating core so as to achieve a jointless configuration of the tub body. This eliminates any joints or edges that would make cleaning difficult. Generally speaking at least the top region 18 of the tub body 3 and the inside surface of the tub body 3 are preferably jointless.

Further components of the bathtub 1, for example cladding elements of the frame structure 2, are made of GFRP in the exemplary embodiment shown.

The tub body 3 has a longitudinal extension 12 and a narrower transverse extension 13, the longitudinal extension 12 preferably measuring between 40 cm and 100 cm. In the exemplary embodiment shown the longitudinal extension 12 is 65 cm. Other longitudinal extensions 12 may be chosen as desired.

The transverse extension 13 is preferably between 30 cm and 70 cm. In the exemplary embodiment shown the transverse extension 13 preferably is between 5 cm and 46 cm respectively.

It is generally preferred for the tub interior 20 to have a volumetric capacity between 30 and 70 liters. A filling level of about 150 mm is in particular intended for the tub body 3 so as to allow bathing infants and babies in a suitable quantity of water or at a suitable water level.

In the exemplary embodiment shown the bathtub 1 is configured mobile or displaceable respectively. To this end the frame structure 2 is provided with a base 24 to which four rollers 25 are attached. Moreover the bathtub 1 is also height-adjustable by way of the lifting tube 22 comprised in the frame structure 2 and operated by the crank 26.

The lifting tube 22 allows adjusting the height of the tub body 3. To this end the crank 26 is operated in the exemplary embodiment shown. It is connected with the lifting tube 22 that is preferably hydraulic.

To ensure sufficient safety against overturning even if the tub body 3 is lifted to a relatively high position, the base 24 accommodates a weight so as to obtain a particularly favorable center of gravity. In the embodiment shown the weight is about 60 kg. The rollers 25 still allow the nursing staff to easily move the bathtub 1 between rooms.

In the embodiment shown the tub body 3 is pivotally received on the frame structure 2. In the illustration shown the tub body 3 is in the bathing position 4. The tub body 3 is shown in a substantially horizontal orientation so as to allow filling the tub interior 20 with water.

The tub body 3 is pivotally received on the frame structure 2 so that the tub body 3 can be pivoted away from the bathing position 4 so as to allow discharging or dumping the water out of the tub interior 20.

In the exemplary embodiment shown the tub body 3 can be put upright by means of the crank 27 wherein this exemplary embodiment is provided with an emptying position 5 in which the tub body 3 is substantially vertical, preferably at 90° to the bathing position 4.

This configuration achieves many advantages. It is a substantial advantage that the tiltable configuration of the bathtub 1 allows to realize the tub body 3 with a closed inner surface 6 since no drain is required in the tub bottom 28. For emptying, the bathtub 1 is simply pushed toward a suitable drain or sink and then tilted from the bathing position 4 to the emptying position 5 by means of the crank 27.

Figure 2:
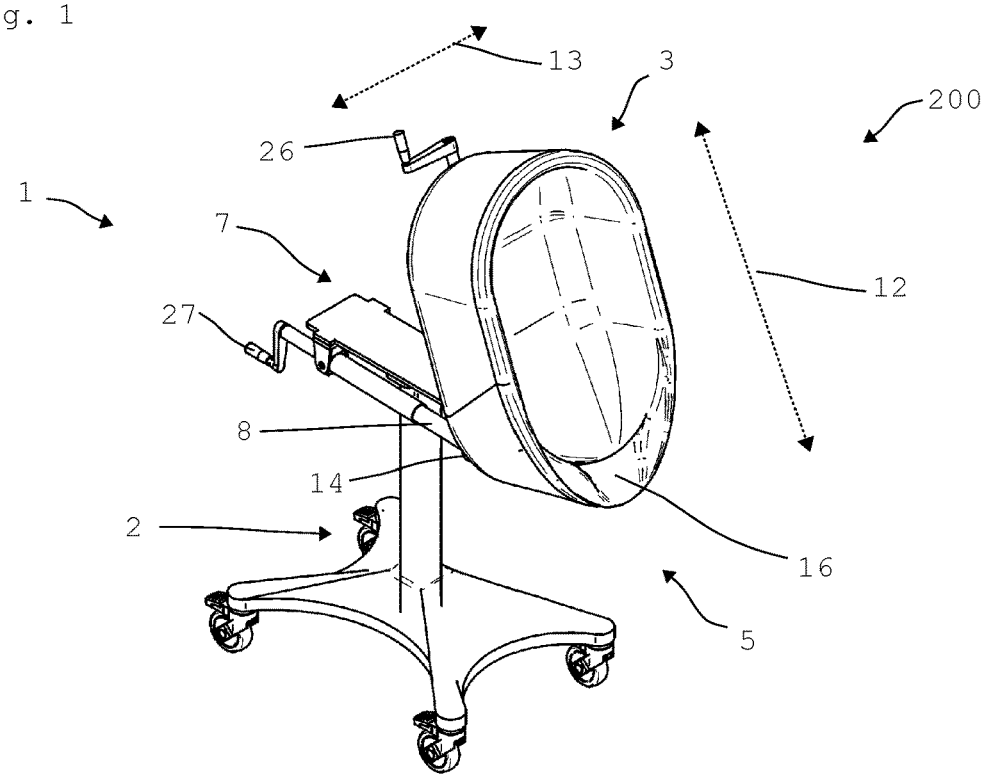
FIG. 2 is a simple schematic illustration of a bathtub according to the invention in the emptying position in a perspective view.

FIG. 2 schematically shows a perspective view of the bathtub 1 shown in FIG. 1, in the emptying position 5. The tub body 3 has been displaced through the pivot device 7 of the frame structure 2 from the bathing position 4 to the emptying position 7 by means of the crank 27.

It can be seen that in the exemplary embodiment shown the pivot axle 14 is disposed transverse to the longitudinal extension 12 of the tub body 3. Thus the bathtub is discharged over its narrower side so that the water can be emptied out of the tub interior 20 particularly target-controlled, thus maintaining hygiene.

To enable particularly good target control in discharging, one side of the tub body 3 is provided with a discharging device 16. This discharging device 16 is formed one-piece with the tub edge 29. The tub edge 29 at the sink side is formed so as to provide a kind of beak or a spout.

Figure 3:
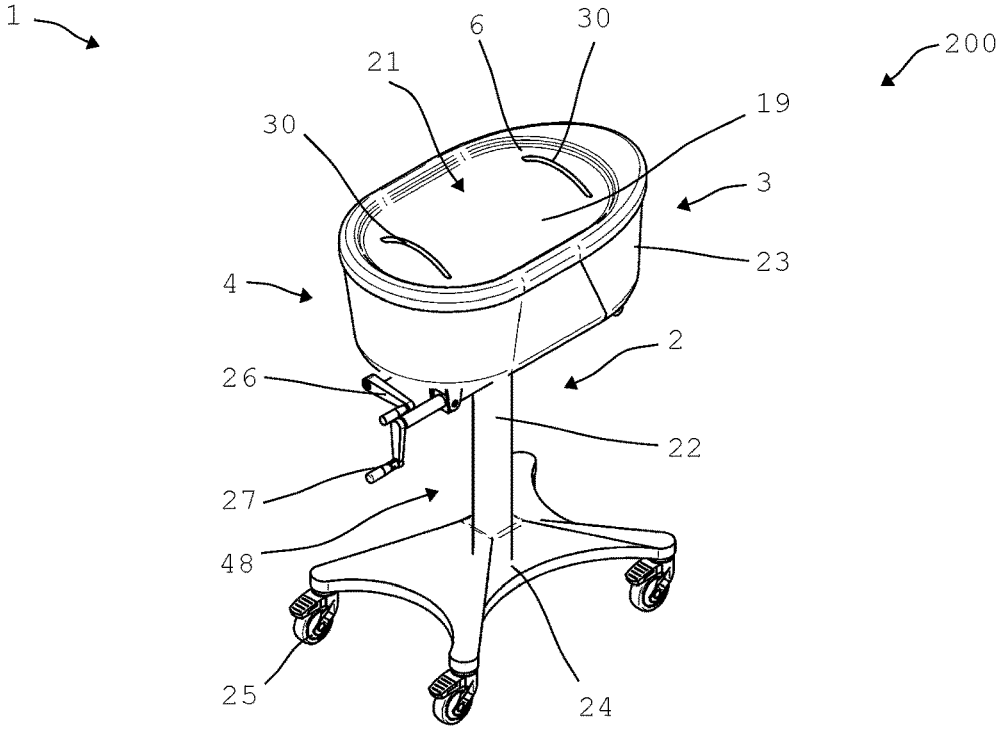
FIG. 3 is a simple schematic illustration of a bathtub according to the invention showing a cover device in place in a perspective view.

FIG. 3 shows the foreshown bathtub 1 in the bathing position 4 with a cover device 19 covering the tub body 3. The covering device 19 comprises two grips 30 for taking the cover device 19 off of the tub body 3.

This cover device 19 allows hygienically closing the tub body 3. Additionally a covering hood, not shown in detail in the Figures, may be provided which is in particular flexible. It can cover the tub body 3 hygienically. Thereafter the cover device 19 can be put on as a rigid cover.

In the embodiment shown the entire cover device 19 is configured to include a storage feature 21. The nursing staff can thus transport care products and auxiliary care materials between rooms together with the bathtub 1.

In the exemplary embodiment shown the cover device 19 is double-walled and comprises an insulating core, presently of PU foam, so that the tub 1 can be transported while containing water wherein the cover device 19 prevents the water from cooling too fast.

Figure 4A:
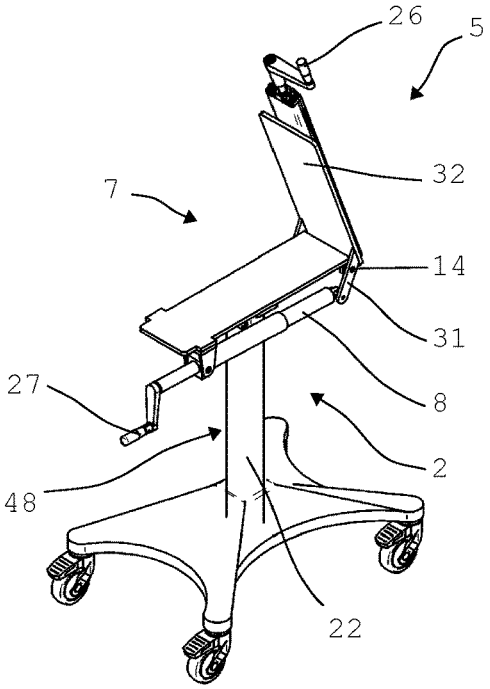
FIG. 4A is a simple schematic illustration of the frame structure of a bathtub according to the invention in the emptying position in a perspective view.
Figure 4B:
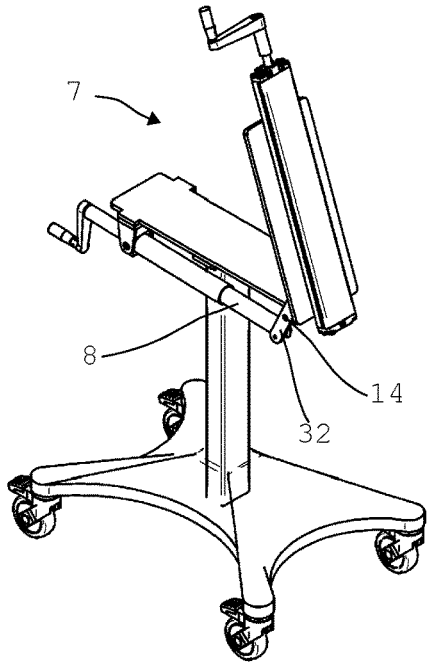
FIG. 4B is a simple schematic illustration of the frame structure of a bathtub according to the invention in the emptying position in another perspective view.

FIGS. 4A and 4B schematically show simple perspective views of the frame structure 2 of the bathtub 1 according to the invention. The pivot device 7 in the exemplary embodiment comprises a plate 31 that is articulated to the pivot axle 14. Using a pivoting lever 32 the plate 31 is pivoted by means of the push tube 8 so as to pivot the tub body 3 and the plate 31 together when the tub body 3 is attached to the plate 31 of the pivot device 7.

Figure 5A:
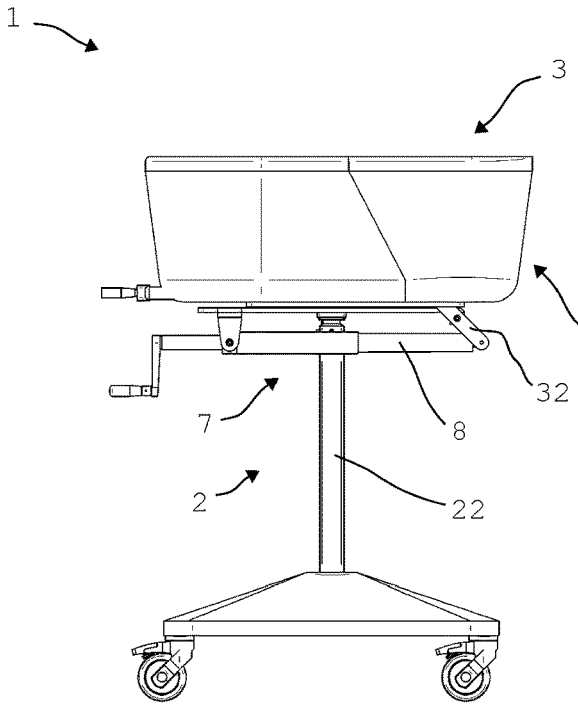
FIG. 5 A is simple schematic illustrations of a bathtub according to the invention in the bathing position in a side view.
FIG. 5B is simple schematic illustrations of a bathtub according to the invention in the bathing position in a top view.
Figure 5B:
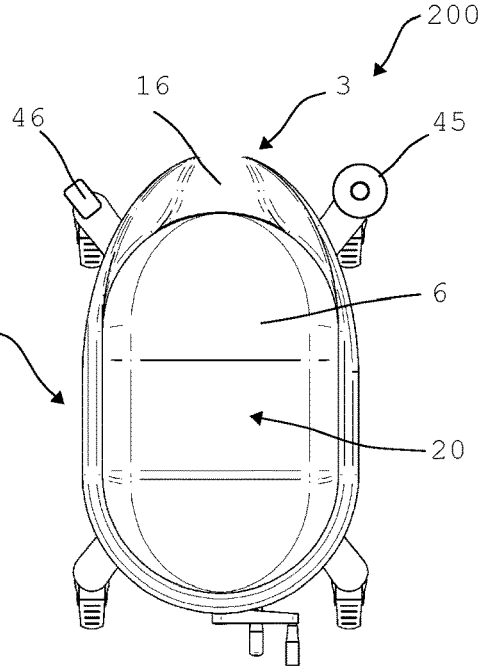

FIG. 5A illustrates the bathtub 1 according to the invention as it has been shown above in a schematic side view. Again one can recognize all the components for height-adjusting the bathtub 1 and pivoting the tub body 3. FIG. 5B shows a top view into the tub interior 20 of the tub body 3.

It is furthermore schematically indicated that all the configurations also provide for disposing protectors at the frame structure 2 or else at the tub body 3 to prevent damage to furniture and/or walls and floors due to moving or pushing the bathtub 1.

The exemplary embodiment shown schematically indicates the use of rollers 45 or rubber-coated rollers and rubber pads 46 (see FIG. 5B). In this instance they are provided at the base 24 of the frame structure 2. Or else they may be attached in other suitable places.

The rubber pad 46 and the roller 45 in the exemplary embodiment shown are moreover adjustable so as to obtain particularly effective results.

Figure 6:
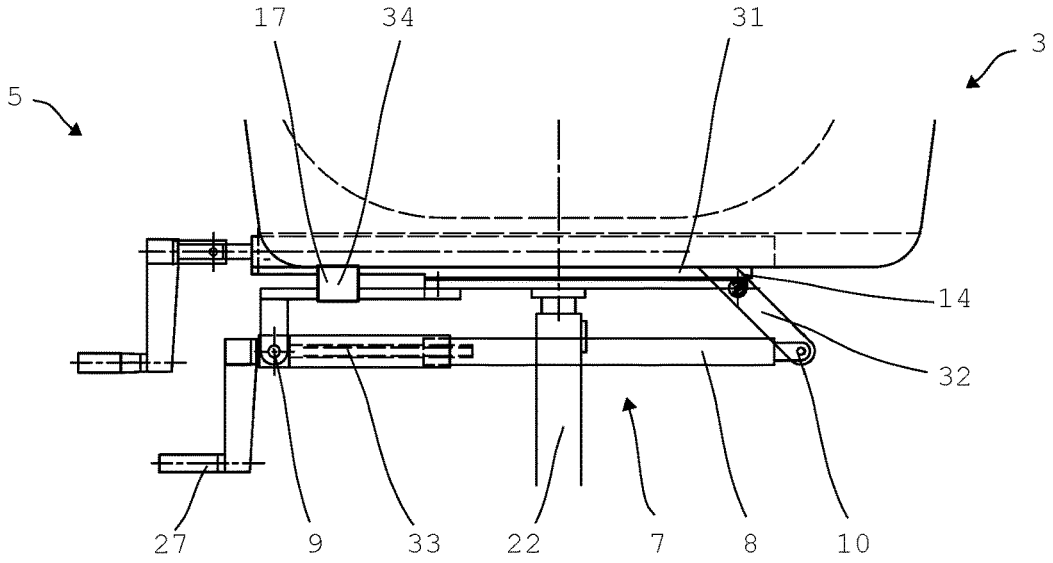
FIG. 6 is a simple schematic illustration of an exemplary embodiment of a pivot device of a bathtub according to the invention in the bathing position in a detail side view.

FIG. 6 schematically shows an enlarged detail of the pivot device 7 of the bathtub 1 according to the invention according to FIG. 5A. Again one recognizes the push tube 8 which can retract and extend by means of a spindle drive 33.

In the embodiment shown the push tube 8 is displaced by turning the crank 27. Displacing the push tube 8 causes the pivoting lever 32 to be pulled or pushed back so that the plate 31 lifts or lowers. In this way the tub body 3 also pivots.

To prevent the bathtub 1 or the tub body 3 from inadvertently shifting from the bathing position 4 to the emptying position 5 the exemplary embodiment shown provides a blocking device 17 that is a bolt 34. Other locking types may be advantageously chosen to prevent inadvertent pivoting of the tub body 3.

Figure 7A:
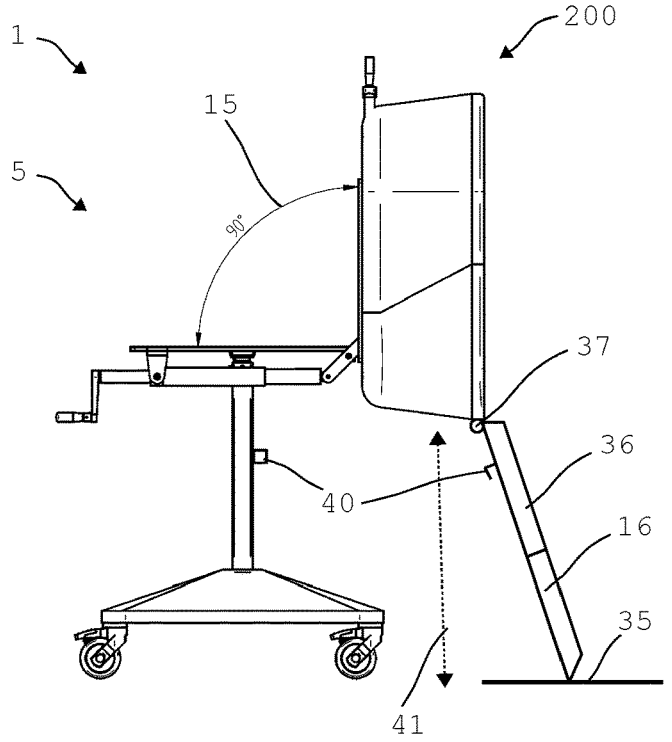
FIG. 7A simple schematic illustrations of a bathtub according to the invention in the bathing position in a side view.
Figure 7B:
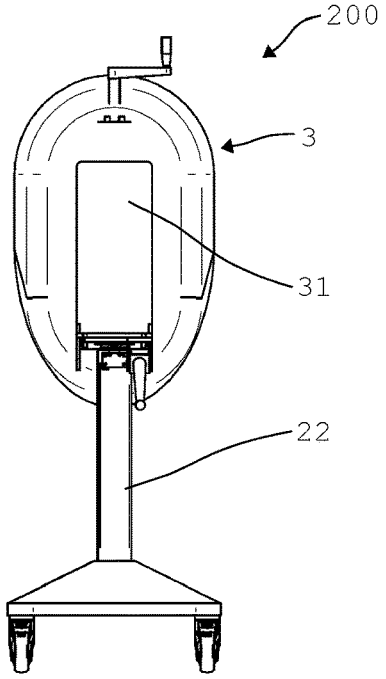
FIG. 7B simple schematic illustrations of a bathtub according to the invention in the bathing position in a rear view.

FIG. 7A shows simply schematically the foreshown bathtub 1 in a schematic side view and FIG. 7B shows a rear view with the tub body 3 shown in the emptying position 5. It can be seen in FIG. 7A that the illustrated exemplary embodiment shows an angle 15 of 90° between the bathing position 4 and the emptying position 5. Any other intermediate position is possible as necessary or required.

The exemplary embodiment shown illustrates just exemplarily that the water is emptied from the tub body 3 into a floor drain 35. In the exemplary embodiment shown, a separate discharging device 16 is used. In the exemplary embodiment shown the discharging device 16 is configured as a telescopic drainpipe or a drainage gutter 36.

The separate discharging device 16 is connected with the tub body 3 prior to pivoting so that in the emptying position 5 the water is routed through the discharging device 16 and in the exemplary embodiment shown through the drainpipe respectively the drainage gutter 36 and is very purposefully guided into the floor drain.

The discharging device 16 in the exemplary embodiment shown is attached to the tub body 3 by means of a suction cup 37. Thus a particularly clean and hygienic emptying of the bathtub 1 is achieved.

In particular in case that the tub body 3 is intended to be discharged into a wash basin or a sink such a discharging device 16 such as a tube, hose, sink gutter or else a sink sheet may be used. Such a discharging device 16 allows clean and target-controlled emptying of the bathtub 1 wherein the water cannot hit for example a wash basin uncontrolled, splashing back up.

One can thus in particular avoid a contamination of care products positioned next to a sink or wash basin or else of faucet-mounted filter systems.

When the discharging device 16 or the drainpipe 36 is not in use, the exemplary embodiment shown allows storing it at the lifting column 22 by means of a suitable holder 40.

Figure 8:
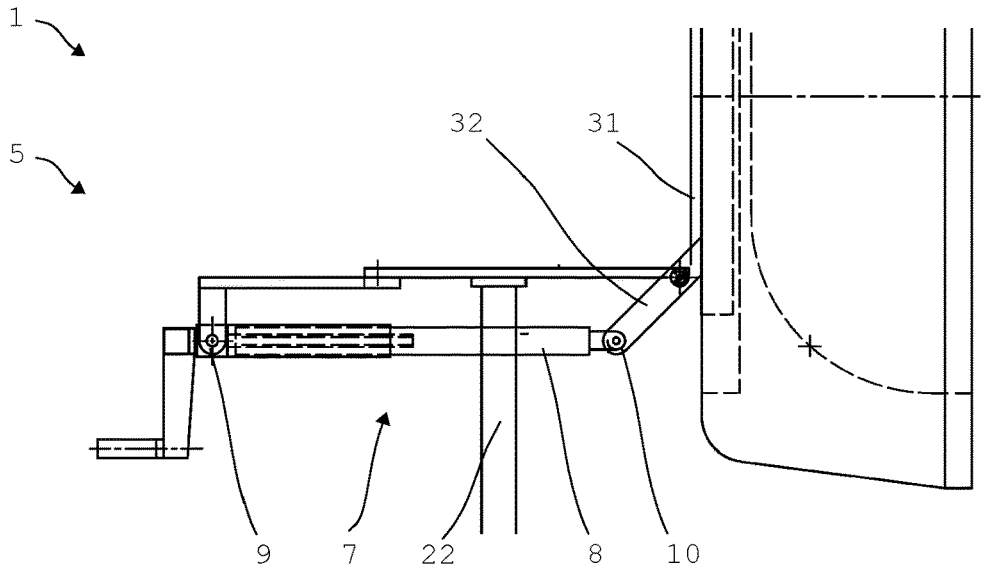
FIG. 8 is a simple schematic illustration of an exemplary embodiment of a pivot device of a bathtub according to the invention in the bathing position in a detail side view.

FIG. 8 schematically shows an enlarged detail of the pivot device 7 of the bathtub 1. One recognizes that the push tube 8 is far withdrawn so that the pivoting lever 32 is retracted whereby the tub body 3 is pivoted from the bathing position 4 to the emptying position 5.

To ensure displaceability of the push tube 8 and pivoting of the plate 31 the push tube 8 in the exemplary embodiment shown is not fixedly connected with the frame structure 2 but has suspensions 9, 10 allowing a certain rotary movability of the push tube 8.

FIG. 9A is a simple schematic illustration of a cover device 19 in a top view and FIG. 9B is a side view. One can recognize that the cover device 19 comprises two grips 30 for securely transporting the cover device 19. Moreover, two depressions are indicated which provide receiving devices 21.

The side view shows small bases 39 attached to the bottom face 38 of the cover device 19 for the cover device 19 to be deposited on a table without having direct contact between the table and the bottom face 38 of the cover device 19.

FIG. 10 shows simply schematically that the bathtub 1 according to the invention may comprise a tub insert 42. This tub insert 42 may show various configurations and in the exemplary embodiment shown it is provided by the cover device 19.

In the embodiment shown the tub insert 42 is configured as a tub reduction 43. This tub reduction 43 is simply placed on the edge of the tub body 3, thus reducing the tub interior 20. This further reduces the quantity of water required.

The illustrated tub reduction 43 may in particular be used for bathing very small children or babies. The reduced tub interior 20 allows to better support the bodies of very small children or babies so as to make bathing more comfortable to the children.

In the exemplary embodiment shown the tub reduction 43 or the tub insert 42 is attached respectively fixed to the tub body 3 by means of setting screws 44 to ensure secure support for the tub insert 42. Other suitable fasteners may be employed advantageously.

Figure 11:
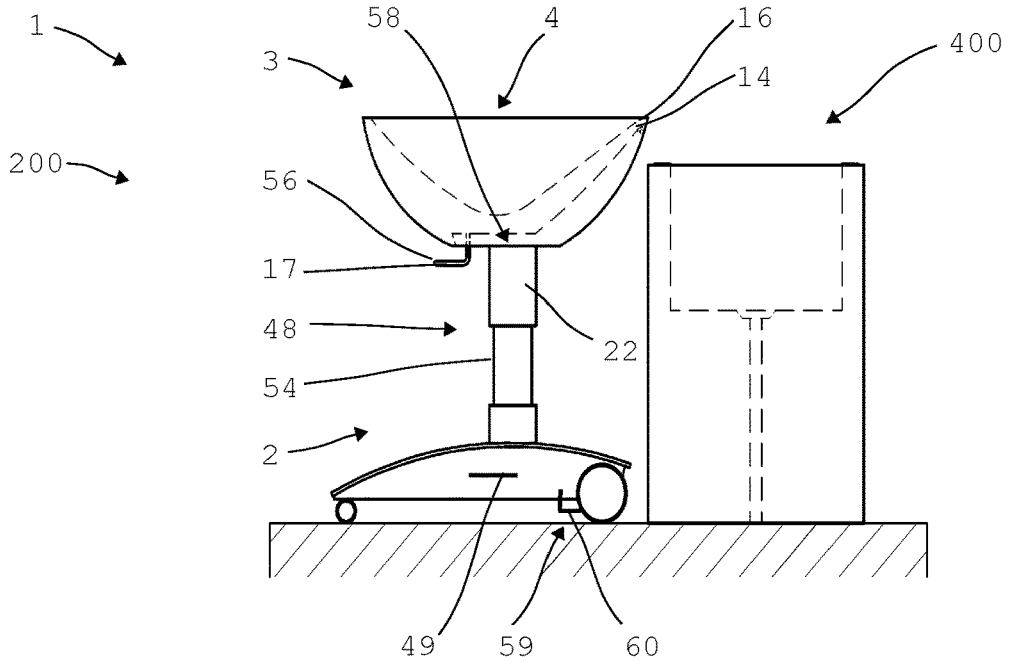
FIG. 11 is a simple schematic illustration of another exemplary embodiment of a bathtub according to the invention in the bathing position in a side view.

FIG. 11 is a simple schematic illustration of another exemplary embodiment of a bathtub 1 or baby bathtub 1 according to the invention. The basic configuration of the illustrated bathtub 1 corresponds to the afore-described exemplary embodiments of bathtubs comprising a frame structure 2 and a tub body 3.

The tub body 1 is pivotally received on the frame structure 2. In this way the tub body 1 can pivot from a bathing position 4 to an emptying position 5 so as to offer ease of emptying the tub body 3. The tub body 3 in FIG. 11 is shown in the bathing position 4.

Again the bathtub 1 or the frame structure 2 shown comprises a height adjusting device 48 by means of which the tub body 3 can be set or adjusted to a suitable working height. In the presently shown exemplary embodiment the lifting tube 22 is not crank-operated but the lifting tube 22 is configured as a hydraulic cylinder 54.

Furthermore a pumping system 49 is provided which the user may operate with his foot. Thus, stepping on the pumping system 49 causes the hydraulic cylinder 54 to extend so that the tub body 3 is displaced upwardly. Depending on the configuration, continued actuation of the pumping system 49 lowers the tub body 3 to the desired height.

This configuration of the height-adjusting device 48 in particular allows the user to optimally adjust the bathtub 1 or the height of the tub body 3 to his or her requirements without using their hands. Thus, a user can in particular adjust the tub height even while bathing a baby, for example if the previously set height is found to be less than optimal or if the tub level must be adjusted during bathing for other reasons.

Since a pumping system 49 is provided which may for example be foot-operated, height adjustment of the bathtub 1 can be realized without requiring the user to interrupt bathing for scrubbing hands so as to avoid contaminating the bathtub from the outside by way of hands soiled due to bathing respectively by contaminated hands.

The base of the frame structure 2 is configured movable and comprises a front and a rear roller pair with the rollers of the rear roller pair designed larger. The smaller rollers of the front roller pair are designed as pivotable casters so as to allow for ease and precision in moving the bathtub 1.

A brake 59 is provided for locking the bathtub 1 in place during use. The brake 59 in the presently shown exemplary embodiment comprises a pivotal brake lever 60 that presses against the rear roller pair as the brake is activated. The brake type presently used is known for example from baby carriages.

Figure 12:
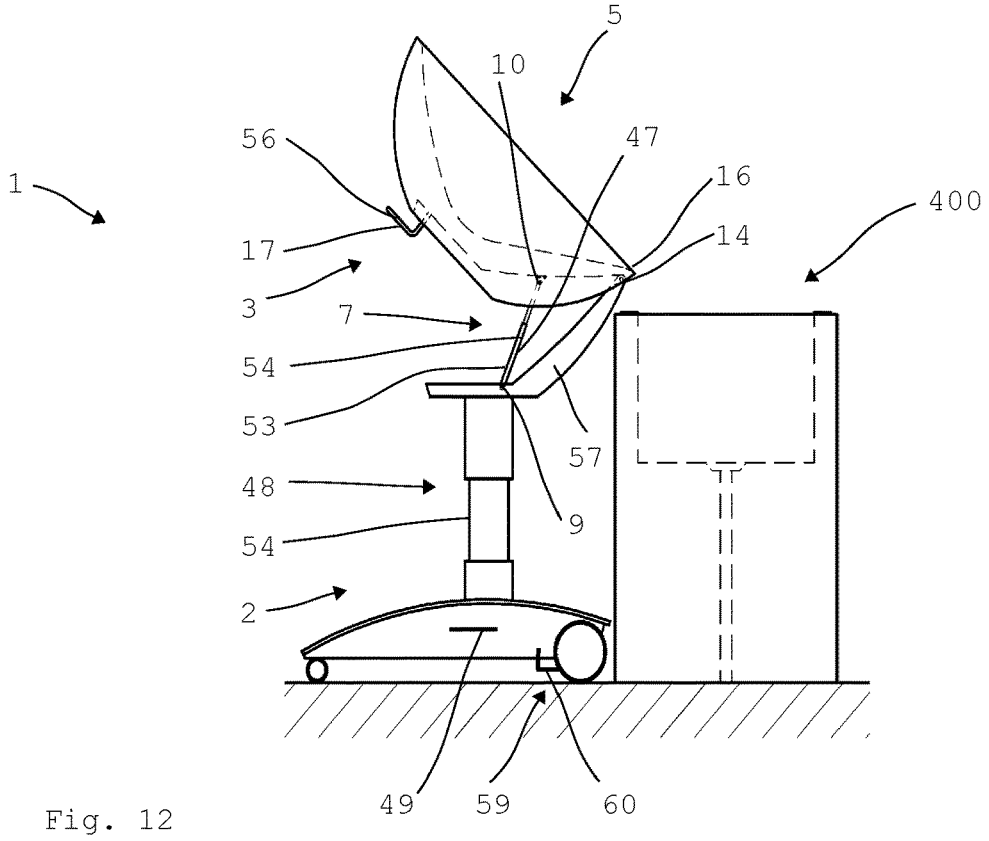
FIG. 12 is the embodiment according to FIG. 11 in the emptying position.

Unlike the exemplary embodiment shown above of a bathtub 1 according to the invention according to the FIGS. 1 to 10 the presently shown exemplary embodiment of FIGS. 11 and 12 provides for the pivot axle 14 of the tub body 3 or the pivot axle 14 provided by the pivot device 7 to be disposed in the region of the discharging device 16.

It is in particular preferred for the pivot axle 14 to be disposed in the top half of the tub body, preferably in the top third and quite preferably in the top quarter of the tub body 3.

As can be seen in the subsequent FIG. 12 a particularly advantageous emptying of the tub body 3 is enabled since the specific positioning of the pivot axle 14 eliminates an unnecessary lifting of the tub body for emptying the water in the tub body 3 into a sink or a wash basin 400.

FIG. 12 once again illustrates the exemplary embodiment of a bathtub 1 according to the invention, which has been shown in FIG. 11, with the tub body 3 pivoted to the emptying position 5.

This illustration clearly shows that the frame structure 2 comprises a supporting arm 57 that displaces the pivot axle 14 around the tub body 3 respectively along the tub body 3 to a top region of the tub body 3.

The pivot axle 14 in the presently shown exemplary embodiment is disposed in the region of the discharging device 16, the discharging device 16 in the presently shown exemplary embodiment being provided by a suitably shaped area in the edge of the tub body 3.

Since the pivot axle 14 is in a top region of the tub body 3, the tub body 3 can be emptied into a wash basin or a sink 400 without having to lift the tub body unnecessarily high by means of the height-adjusting device 48. This in particular offers the advantage that depending on the configuration a height adjusting device 48 having a shorter extension may be employed and that the bathtub 1 maintains particularly good stability even during emptying.

To support the user in emptying the bathtub 1 respectively in emptying the tub body 3 the pivot device 7 in the presently shown exemplary embodiment comprises a biasing device 47.

This biasing device 47 is configured as a gas pressure spring 53 that assists the user while pivoting the tub body 3 from the bathing position 4 to the emptying position 5.

The presently shown exemplary embodiment provides for the biasing device 47 respectively the gas pressure spring 53 to engage for supporting the tub body 3 only as soon as the user has lifted the tub body 3 employing a specified force. It may be provided that a user needs to apply for example an initial lifting force of 6 kilograms or more or less until the gas pressure spring 53 is activated.

In other configurations a specific rotational angle may be provided which must be reached for the biasing device 47 respectively the gas pressure spring 53 to be activated.

In other embodiments, not shown, the biasing device 47 may for example be provided by a hydraulic cylinder 54 which can in turn be operated e.g. by means of a pump device. Thus, in analogy to extending the push tube 22 or in analogy to height adjusting the bathtub 1, the bathtub may also be emptied by means of a hydraulic cylinder 54.

To prevent accidental pivoting of the tub body 3 from the bathing position 4 to the emptying position 5, a blocking device 17 is also provided here.

The blocking device 17 in the presently shown exemplary embodiment has a release lever 56 which releases a locking system 58 as the release lever 56 is actuated so as to allow pivoting the tub body 3. As the tub body 3 is displaced back from the emptying position 5 to the bathing position 4, the locking system 58 latches automatically for the tub body 3 to rest securely on the frame structure 2 in the bathing position.

Figure 13:
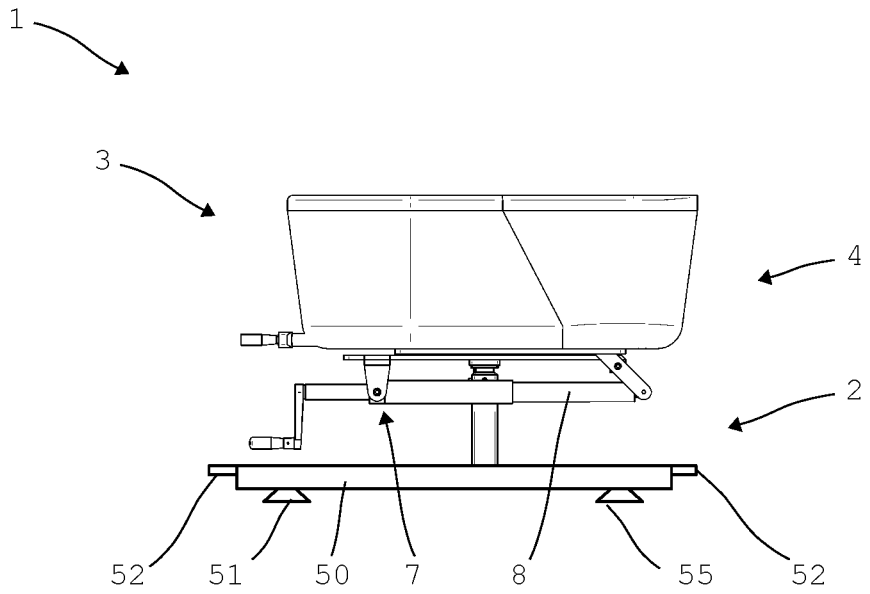
FIG. 13 is a simple schematic illustration of another exemplary embodiment of a bathtub according to the invention in the bathing position.
Figure 14:
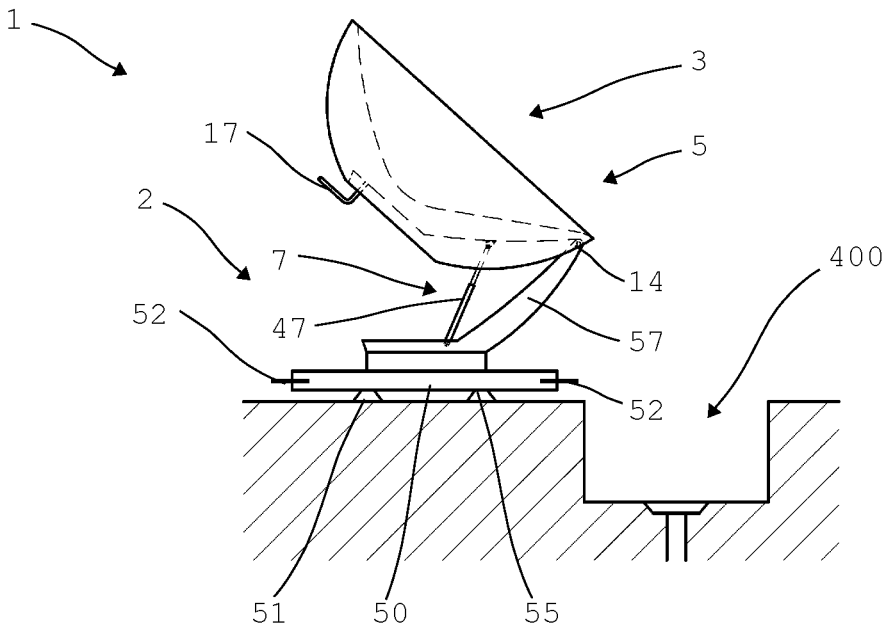
FIG. 14 is a simple schematic illustration of another exemplary embodiment of a bathtub according to the invention in the bathing position.

The FIGS. 13 and 14 illustrate the exemplary embodiments according to the FIGS. 1-10 and 11-12 but with different frame structures 2. The embodiments according to FIGS. 13 and 14 do not provide for a movable base or movable frame structure 2.

In the two embodiments shown in FIGS. 13 and 14 the frame structure 2 comprises a stand 50 by means of which the bathtubs 1 can be placed on any desired suitable surface.

The bathtubs 1 having a stand 50 may for example be placed on the working surface of a standard transporting cart for care products or on some type of a serving cart. Alternatively the bathtub may be placed on the working surface next to a sink or wash basin 400 as shown in FIG. 14.

Thus the bathtub 1 having a stand 50 may be used with flexibility as required, for example by manual transport to the intended point of use or else placement on a cart.

For ease of transporting the bathtub 1 the embodiments shown are provided with grips 52. This allows carrying the bathtub 1 back and forth between points of use or else putting it onto a mobile base.

Furthermore the Figures schematically show fasteners 51 provided at the stand 50. The fastener 51 allows secure placement of the bathtub 1 at the point of use.

To ensure particular flexibility of use, the two embodiments shown each provide for fasteners 51 in the shape of suction cups 55 to securely attach the bathtub 1 to a surface at the point of use.

Other configurations may provide for different fixing members for fasteners 51. The stand 50 may for example be provided with through holes to be used for example in conjunction with a bolt and matching swivel nut for fastening.

Depending on the configuration the bathtub 1 may be attached to a surface magnetically, by clipping, gluing, by ratchet straps or else Velcro® hook or loop straps. Generally speaking, a temporary or detachable fastening is preferred.

It is obvious and preferred for the features of the four exemplary embodiments described according to the FIGS. 1 to 14 to be combined with each other as desired to obtain other inventive embodiments.

Figure 15A:
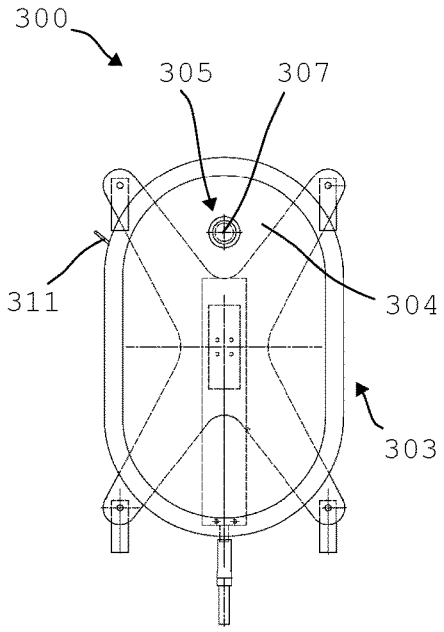
FIG. 15A is a simple schematic illustrations of another bathtub according to the invention in the bathing position in a top view.
Figure 15B:
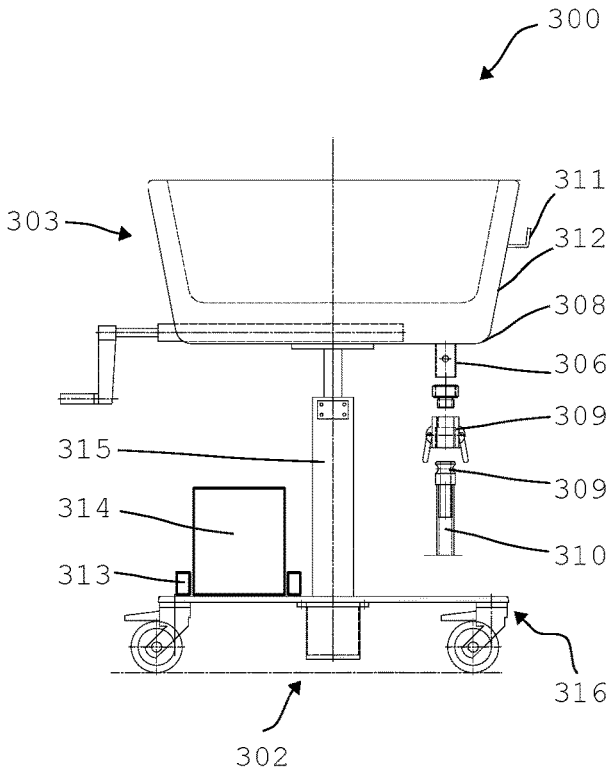
FIG. 15B is a simple schematic illustrations of another bathtub according to the invention in the bathing position in a side view.

FIGS. 15A and 15B are simple schematic illustrations of another exemplary embodiment of a bathtub 300 according to the invention. Unlike the bathtub 1 shown above this bathtub 300 does not have a continuous inner surface 6 of the bathtub 1. In this embodiment a drainage device 305 is provided in the tub bottom 304.

As provided in the embodiment shown in FIGS. 15A and 15B, the bathtub 300 comprises a frame structure 302 and a tub body 303, the frame structure 302 again comprising a lifting tube 315 with which to advantageously set and adjust the height of the tub body 303 as required.

To still provide a bathtub 300 for particularly good cleaning, the drainage device 305 comprises a tube 306 extending below the lower end 308 of the tub body 303.

The tube 306 is connected with the drain hole 307 jointless, extending through the tub bottom 304 as a smooth, continuous tube 306. The drainage device 305 in the exemplary embodiment shown is integrally formed with the tub body 303. Thus, a jointless connection is again formed with the tub bottom 304.

In other configurations the drainage device 305 may be a separate component, which is for example screwed, glued, or else clamped to or into the tub bottom 304 or else attached otherwise.

Depending on the application and requirements a quick release 309 or a hose device 310 may be immediately attached to the free end of the tube 306.

In the configuration of the drainage device 305 the tube 306 protruding beneath the tub bottom 308 provides a particularly easily cleaning drain for a bathtub 300. This tube 306 provides for particularly easy cleaning for example by means of a brush. All the other components such as the quick release 309 or else a hose system 310 may be removed prior to cleaning and may then for example be autoclaved.

In the embodiment shown the tub body 303 comprises on its outside surface 312 a holding device 311 for the hose device 310 or the free end of the hose device 310 to hook on. The holding device 311 is disposed at the outside surface 312 of the tub body 303 so that the free end of the hose device 310 hooks in above the filled water level. This automatically closes the drainage device 305 as soon as the hose device 310 hooks into the holding device 311.

For emptying the bathtub 300 the hose 310 is removed from the holding device 311 and then it may be placed, for example, into a drain or a wash basin for emptying. The tub height may be varied as needed.

In the exemplary embodiment shown an accommodation 313 is provided at the base 316 of the frame structure 302 into which an outflow vessel 314, such as a bucket, can be placed. Thus the nursing staff can empty the bathtub 300 or the tub body 303 batchwise into the outflow vessel 314 so as to enable particularly back-friendly batchwise emptying of the bathtub 300.

LIST OF REFERENCE NUMERALS

1 bathtub
2 frame structure
3 tub body

4 bathing position
5 emptying position
6 inner surface
7 pivot device
8 push tube
9 suspension
10 suspension
11 motor device
12 longitudinal extension
13 transverse extension
14 pivot axle
15 angle
16 discharging device
17 blocking device
18 top region
19 cover device
20 interior
21 storage feature
22 lifting tube
23 GFRP
24 base
25 roller
26 crank
27 crank
28 tub bottom
29 tub edge
30 grip
31 plate
32 pivoting lever
33 spindle drive
34 bolt
35 floor drain
36 drainpipe
37 suction cup
38 bottom face
39 foot
40 holder
41 draining height
42 tub insert
43 tub reduction
44 setting screw
45 roller
46 pad
47 biasing device
48 height adjusting device
49 pumping system
50 stand
51 fastener
52 grip arrangement
53 gas pressure spring
54 hydraulic cylinder
55 suction cup
56 release lever
57 supporting arm
58 locking device
59 brake
60 brake lever
200 baby bathtub and/or infant bathtub
300 bathtub
302 frame structure
303 tub body
304 bottom
305 drainage device
306 tube
307 drain hole
308 lower end
309 quick release
310 hose device
311 holding device
312 outside surface
313 accommodation
314 outflow vessel
315 lifting tube
316 base
400 sink/wash basin

The invention claimed is:

1. A baby and/or infant bathtub, comprising:

at least one frame structure comprising a wheeled base and a pivot device, at least one tub body comprising a longitudinal extension and a shorter, transverse extension whereby the tub body has a narrower side, and having a volumetric capacity suitable for a baby or an infant, the tub body being pivotally accommodated on the frame structure by the pivot device wherein the pivot device provides a pivot axle for the tub body that is oriented substantially transverse to the longitudinal extension, the tub body being pivotal at least between a bathing position and at least one emptying position, the tub body having an entirely closed inner surface and a tub edge, wherein the at least one emptying position will permit any water contained in the tub body to discharge over the tub edge of the tub body located at the narrower side of the tub body.

2. The bathtub according to claim 1 wherein the wheeled base comprises at least one pair of rollers.

3. The bathtub according to claim 2 wherein at least one of the at least one pair of rollers is provided with a brake capable of locking the at least one of the at least one pair of rollers.

4. The bathtub according to claim 1 wherein the pivot axle is provided in the top half of the tub body.

5. The bathtub according to claim 1 wherein the pivot axle is provided in the top third of the tub body.

6. The bathtub according to claim 1 wherein the pivot axle is provided in the top quarter of the tub body.

7. The bathtub according to claim 1 wherein the tub body comprises at least one discharging device.

8. The bathtub according to claim 7, characterized in that the pivot axle is attached to the tub body in the region of the discharging device.

9. The bathtub according to claim 2 wherein the pivot device comprises at least one of a push tube and a biasing device.

10. The bathtub according to claim 1 wherein at least one blocking device is provided.

11. The bathtub according to claim 9 wherein the suspension of at least one of the push tube and the biasing device is configured for rotary motion.

12. The bathtub according to claim 9 wherein the push tube is provided for at least one of manual and automatic actuation.

13. The bathtub according to claim 1 wherein at least one motor device is provided for actuating the pivot device.

14. The bathtub according to claim 1 wherein the tub body is double-walled at least in sections.

15. The bathtub according to claim 1 wherein the angle between the bathing position and the emptying position is at least 30°.

16. The bathtub according to claim 1 wherein the angle between the bathing position and the emptying position is at least 45°.

17. The bathtub according to claim 1 wherein the angle between the bathing position and the emptying position is at least 75°.

18. The bathtub according to claim 1 wherein the angle between the bathing position and the emptying position is at least 90°.

19. The bathtub according to claim 1 wherein the tub body is configured to be jointless at least in a top region.

20. The bathtub according to claim 1 wherein the tub body is manufactured one-piece.

21. The bathtub according to claim 1 wherein at least one cover device is provided for covering the interior of the tub body.

22. The bathtub according to claim 21 wherein at least one of the tub body and the cover device provides at least one storage feature.

23. The bathtub according to claim 1 wherein the tub body is configured detachable from the frame structure.

24. The bathtub according to claim 1, characterized in that the frame structure comprises a height adjusting device and the height adjusting device comprises a pumping system.

25. The bathtub according to claim 1 wherein the frame structure comprises at least one stand comprising at least one of a fastener and a grip arrangement.

26. A method of emptying a bathtub comprising the steps of:

providing a baby and/or infant bathtub, comprising at least one frame structure comprising a wheeled base and a pivot device, at least one tub body comprising a longitudinal extension and a shorter, transverse extension whereby the tub body has a narrower side, and having an entirely closed inner surface and a tub edge, the tub body having a volumetric capacity suitable for a baby or an infant, the tub body being pivotally accommodated on the frame structure by the pivot device wherein the pivot device provides a pivot axle for the tub body that is oriented substantially transverse to the longitudinal extension, the tub body being pivotal at least between a bathing position and at least one emptying position, wherein the at least one emptying position will permit any water contained in the tub body to discharge over the tub edge of the tub body located at the narrower side of the tub body;

at least partially filling the tub body with water;

rolling the baby and/or infant bathtub to above a sink or drain, and pivoting the tub body from the bathing position to the emptying position for emptying the water in the tub body over the tub edge of the tub body located at the narrower side of the tub body and into the sink or drain.

27. The method according to claim 26 further comprising providing a separate discharging device attached to the tub body at the tub edge of the tub body located at the narrower side of the tub body for emptying.

28. The method according to claim 27 further comprising the steps of:

providing a blocking device and a biasing device;

releasing the blocking device; and lifting the tub body until the biasing device engages.

* * * * *